United States Patent [19]

Bisschops et al.

[11] 4,341,644

[45] Jul. 27, 1982

[54] QUATERNARY AMMONIUM SALT MIXTURES

[75] Inventors: Yvan Bisschops, Antwerp; Emmanuel Draguez Tripels de Hault, Waterloo; Aleksef Jnoff, Nivelles; Alain Delaby, Brussels, all of Belgium

[73] Assignee: Lilachim, Brussels, Belgium

[21] Appl. No.: 306,457

[22] Filed: Sep. 28, 1981

[30] Foreign Application Priority Data

Oct. 10, 1980 [LU] Luxembourg ..... 82836

[51] Int. Cl.[3] ..... D06M 13/46

[52] U.S. Cl. ..... 252/8.8

[58] Field of Search ..... 252/8.8

[56] References Cited

U.S. PATENT DOCUMENTS 3,274,106 9/1966 Smiens ..... 252/8.8

FOREIGN PATENT DOCUMENTS 55-112375 8/1980 Japan ..... 252/8.8

55-112376 8/1980 Japan ..... 252/8.8

55-112377 8/1980 Japan ..... 252/8.8

55-116877 9/1980 Japan ..... 252/8.8

*Primary Examiner*—Maria Parrish Tungol

[57] ABSTRACT

Quarternary ammonium salts compositions comprising a mixture of quaternary ammonium salts of general formula

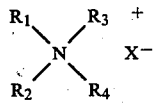

wherein $R_1$ and $R_2$ are aliphatic radicals having from 10 to 22 carbon atoms and in which the aliphatic radicals are saturated aliphatic straight chains, unsaturated aliphatic chains and branched aliphatic chains, and wherein $R_3$ and $R_4$ are alkyl radicals having from 1 to 4 carbon atoms and X is a quaternary anion.

9 Claims, No Drawings

QUATERNARY AMMONIUM SALT MIXTURES

BACKGROUND OF THE INVENTION

The present invention relates to quaternary ammonium salt mixtures having softening and antistatic properties for natural and synthetic textiles or mixtures thereof. More particularly, the present invention relates to quaternary ammonium salt mixtures which are liquid at room temperature.

At the present time, the softening compositions used for textile conditioning after the washing cycle, are essentially cationic products such as dialkyldimethyl ammonium chlorides or alkylamido alkyl imidazolines. The alkyl chains present in these compounds essentially result from hydrogenated or unhydrogenated tallow. These cationic products, most of which are quaternary ammonium compounds, are in the form of a paste constituted of about 75% quaternary ammonium salt in a mixture of isopropyl alcohol and water. However, the textile softeners generally are commercialized in the form of an aqueous dispersion containing from 2 to 9% quaternary ammonium salt. This dispersion is generally prepared by heating the starting quaternary ammonium salt to a temperature higher than 40° C., and then dispersing the quaternary ammonium salt containing liquid in hot water.

A drawback of this type of product resides in the fact that the starting material is pasty and that two operations are required to present it in a commercializable suitable form. Also, the quaternary ammonium salt content of these aqueous dispersions is strictly limited to a maximum of 9%, because, at higher contents, gel formation results and the dispersion becomes unstable.

In order to overcome these drawbacks, it has been proposed to use cyclic derivatives of the imidazoline type. These latter are not completely liquid at room temperature but they are dispersible in the cold state. However, these products have lower softening properties and they are less stable to storage.

Other cationic products, liquid at room temperature and having softening properties, are also known in the art, but these products have various disadvantages, such as instability in an aqueous medium, low performance with regard to softening properties, or still gel formation at concentrations higher than 9%. Quaternary dialkyl esters, alkyltrimethylammonium chlorides, and dialkyldimethyl ammonium chlorides having short alkyl chains, are examples of these products.

There is, therefore, a need for a concentrated softening composition which is liquid, easily handable at room temperature and readily dispersible in cold water; and that would reduce the time required for preparation of the composition and which would avoid treatments which present some danger such as that which is due to the flash point of isopropyl alcohol contained in the paste.

SUMMARY OF THE INVENTION

The object of the present invention is to present a quaternary ammonium salt mixture which is liquid at room temperature and dispersible in cold water.

Another object of the present invention is to present a new textile softener compound, prepared from a mixture of quaternary ammonium salts.

Still another object of the present invention is to present a new textile softener compound which can be in a concentrated form.

A further object of the present invention is to present a new textile softener compound, prepared from a mixture of quaternary ammonium salts, which has excellent softening and antistatic properties, and which does not yellow textiles treated with such compound.

The quaternary ammonium salt compositions of the present invention consist of a mixture of quaternary ammonium salts of general formula

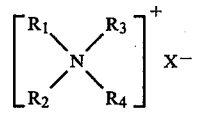

wherein $R_1$ and $R_2$ are aliphatic radicals, each having from 10 to 22 carbon atoms, and wherein (a) from 40 to 75% by weight of the entirety of said aliphatic radicals are saturated aliphatic straight chains, and (b) from 5 to 45% by weight of the entirety of said aliphatic radicals are unsaturated aliphatic chains, and (c) from 3 to 55% by weight of the entirety of said aliphatic radicals are branched aliphatic chains, and the sum of A+B+C being equal to 100, and wherein $R_3$ and $R_4$, which may be identical or different, are alkyl radicals having from 1 to 4 carbon atoms and wherein X is a conventional quaternary anion.

It has unexpectedly been found that the above described mixture of quaternary ammonium salts has very desirable properties. Such mixtures are liquid at room temperature, dispersible in the cold state, and have the possibility of being in a concentrated form without gel formation. Further, the quaternary ammonium salts within the mixture, when used alone, do not possess all of these properties. Moreover, these mixtures of quaternary ammonium salts allow the preparation of textile softening compositions having excellent softening and antistatic properties.

These unexpected results are all the more surprising since when unhydrogenated tallow is used as the sole starting material, the quaternary ammonium salt obtained is not liquid at room temperature and further, forms a gel when dispersions of more than 10% in water are prepared. Moreover, when a mixture of unsaturated fatty acids is used as the starting material, it has to be submitted to a severe hydrogenation to avoid a yellowing effect of the resulting quaternary ammonium salt on textiles treated with such salt. The quaternary ammonium salts resulting from these starting materials to not possess the desired properties, because they do not fulfill the above recited conditions with regard to saturation, unsaturation and branching.

DETAILED DESCRIPTION OF PREFERRED EMBODIMENTS

It has been found that the desired properties depend on the simultaneous presence of quaternary ammonium salts of the above described general formula, whose radicals, $R_1$ and $R_2$ possess saturated aliphatic straight chains, unsaturated aliphatic chains, and branched aliphatic chains within the above defined proportions, the number of carbon atoms of each of these different chains ranging between 10 and 22.

The quaternary ammonium salts of the present invention are formed with a conventional quaternary anion which is selected from the group comprising the halogens such as chlorine or bromine, and radicals such as $CH_3SO_4^-$, nitrate, acetate and ethylsulfate. However, it has been found that the relative proportions of the different types of aliphatic chains are relatively critical. Compositions containing less than 3% by weight of branched chains are not dispersible in the cold state, while compositions containing more than 55% by weight of aliphatic branched chains do not possess good softening properties. Further, compositions containing less than 5% by weight of unsaturated aliphatic chains do not permit preparation of a composition in concentrated form without a gelification of the product, while compositions containing more than 45% by weight of unsaturated chains lead either to liquid products which have poor softening properties, or to products which are not liquid at room temperature. With regard to the saturated aliphatic straight chains, compositions containing more than 75% by weight of these chains lead to products which are not liquid at room temperature, while compositions containing less than 40% by weight of these chains lead to products which have poor softening properties.

It also has been determined that the length of the saturated aliphatic straight chains is intimately bound to the relative proportions of the branched aliphatic chains and the unsaturated chains present in the mixture. In this regard, it has been found that in compositions containing a low amount of branched aliphatic chains, such as between 3 and 9% by weight, and an amount of unsaturated aliphatic chains of between 5 and 45% by weight, the amount of saturated straight chains should comprise from 20 to 35% by weight of chains having from 12 to 15 carbon atoms and from 80 to 65% by weight of chains having from 16 to 22 carbon atoms, with a high proportion of chains having from 16 to 18 carbon atoms. To the contrary, in compositions where the proportion of aliphatic branched chains is more important, such as those ranging between 12 and 55% by weight, the amount of saturated aliphatic straight chains having less than 16 carbon atoms should be lower than 10% by weight of the total amount of chains.

According to an embodiment of the present invention, the quaternary ammonium salt compositions are obtained by mixing different quaternary ammonium salts in adequate proportions to form a final mixture meeting the conditions of the present invention. Accordingly, a quaternary ammonium salt may be prepared from a mixture of alcohols comprising straight chain aliphatic alcohols having from 16 to 22 carbon atoms, and oxoalcohol whose aliphatic chains have from 10 to 16 carbon atoms, with 20 to 25% by weight of the chains being branched. Such a mixture of alcohols is reacted with ammonia to form the corresponding amine, this amine then being quaternized by reaction with $CH_3X$ wherein X is a halogen or the radical $CH_3SO_4^-$, to form the corresponding quaternary ammonium salt. Additionally, a quaternary ammonium salt is prepared either from a fatty acid whose aliphatic chains have from 12 to 22 carbon atoms, more particularly from 16 to 18 carbon atoms, some of them being unsaturated, or from a mixture of fatty acids comprising saturated aliphatic straight chains, unsaturated and branched chains, having from 12 to 22 carbon atoms, more particularly from 16 to 18 carbon atoms.

For reasons of availability, the unhydrogenated tallow fatty acid is most often used as a fatty acid having unsaturated aliphatic chains. Thereafter and according to known processes the fatty acid or the mixture of fatty acids is reacted successively with ammonia and hydrogen to form the corresponding amine, and with $CH_3X$ where X is a halogen or the radical $(CH_3)SO_4^-$, to form the corresponding quaternary ammonium salt. These reactions are carried out in order to keep the unsaturation in the final product. The quaternary ammonium salts prepared from alcohols is mixed with the quaternary ammonium salt prepared from fatty acid, in weight proportions which may vary between 80–20 and 20–80, particularly between 75–25 and 25–75. However, the quaternary ammonium salts are preferably mixed in equal amounts.

According to another embodiment, the mixture of quaternary salts in the same proportions as hereabove described is prepared by blending the amines followed by the quaternization of the amine mixture.

According to a further embodiment, one can start with only a mixture of fatty acids meeting the above defined conditions of unsaturation and branching. The fatty acid mixture is then converted to the amines and finally to the quaternary ammonium salts of said fatty acid mixture.

Textile softener compositions can be prepared by dispersing the compositions of the present invention in water, at room temperature. These textile softener compositions can be prepared under a more concentrated form than that of the usual compositions, generally at a concentration of about 20% by weight, without any gelification of the product. The textile softener compositions resulting from the compositions of the invention have excellent softening and antistatic properties.

The following examples are presented for the purpose of better illustrating the present invention but without intention to limiting such invention.

EXAMPLE 1

A fatty acid, having the composition set forth below, was converted into a secondary amine, according to a usual process.

Fatty acid composition:

| | |
|---|---|
| chains lower than $C_{12}$ | 0.5% by weight |
| chain in $C_{14}$ | 3.8% |
| $C_{14}$ branched | 0.4% |
| $C_{16}$ | 27.1% |
| $C_{16}$ branched | 4% |
| $C_{17}$ branched | 15% |
| $C_{18}$ | 16.5% |
| $C_{18}$ branched | 23% |
| $C_{18'}$ | 4.7% |
| $C_{18''}$ | 4% |
| $C_{20}$ branched | 1% |

The chains designated by $C_{18'}$ and $C_{18''}$ are unsaturated aliphatic chains having 18 carbon atoms and comprising respectively, 1 and 2 double bonds. In said fatty acid composition, the aliphatic branched chains amounted to 43.4%. The iodine index according to the method AOCS Tg 1a-64 was 44.1.

The amine obtained comprised 8.1% primary amine, 84.9% secondary amine, and 7% tertiary amine.

Next, an unhydrogenated tallow fatty acid, having the composition hereinafter described, was converted into a secondary amine, according to a usual process.

Composition of the fatty acid

| | |
|---|---|
| chain in $C_{14}$ | 2% by weight |
| $C_{16}$ | 25% |
| $C_{16'}$ | 3% |
| $C_{18}$ | 19% |
| $C_{18'}$ | 41% |
| $C_{18''}$ | 6% |
| $C_{18'''}$ | 1% |
| $C_{20}$ | 2% |

Said acid has an iodine index of 47, but it did not contain any branched chain.

The amine obtained comprised 86% secondary amine, about 7% primary amine and 7% tertiary amine.

The amines obtained from the above described fatty acids amines were mixed in a weight ratio of 1/1 and the mixture was quaternized by reaction with $CH_3Cl$ at 100° C. under a pressure of 3 kg in the presence of isopropyl alcohol. NaOH was added during the reaction, and at the end of the reaction, the mixture was filtered to remove NaCl formed during neutralization. The product obtained comprised 75% of quaternary ammonium salt in a mixture of water and isopropyl alcohol.

The product obtained was liquid at room temperature and its properties were as follows (properties determined on the product free from water and isopropyl alcohol):

| | |
|---|---|
| Iodine index | 43 |
| Branched chains | 21.7% by weight |
| Chains lower than $C_{16}$ | 5.3% by weight |
| Unsaturated chains | 29.5% by weight |

A textile softener was prepared from this product by dispersing 67 grams of the quaternary ammonium salt mixture prepared as above described into one liter of tap water, at a temperature of 17° C. The dispersion was rapid and homogeneous, and the viscosity of the end product was about 250 centipoises.

An aqueous dispersion containing 20% of quaternary ammonium salt was also prepared in the same conditions as those above described, in order to obtain a liquid concentrated textile softener. The viscosity of said dispersion was about 600 centipoises, and no gelification was observed.

EXAMPLE 2

A secondary amine of unhydrogenated tallow, resulting from the unhydrogenated tallow fatty acid described in example 1, was mixed, in a weight ratio of 3/1, with a secondary amine resulting from a synthetic alcohol, whose composition is as follows:

Composition of the alcohol:

| | |
|---|---|
| Chain in $C_{11}$ | 2% by weight |
| $C_{12}$ | 18.2% |
| $C_{12}$ branched | 6.1% |
| $C_{13}$ | 18.5% |
| $C_{13}$ branched | 6.2% |
| $C_{14}$ | 22.9% |
| $C_{14}$ branched | 7% |
| $C_{15}$ | 14.5% |
| $C_{15}$ branched | 4.7% |

Said synthetic alcohol contained 24% by weight of aliphatic branched chains. The amine obtained from said alcohol was comprised of 77% secondary amine, 3% primary amine and 17% tertiary amine.

The mixture of amines was quaternized, and the salt formed filtered. A product, liquid at room temperature, was obtained. This product was comprised of 75% quaternary ammonium salt in a mixture of water and isopropyl alcohol. The properties of this quaternary ammonium salt were as follows:

| | |
|---|---|
| Iodine index | 30 |
| Branched chains | 6% by weight |
| Chains lower than $C_{16}$ | 26% by weight |
| Unsaturated chains | 39% by weight |

A liquid textile softener containing 5% of the quaternary ammonium salt prepared above was prepared by dispersing 67 grams of said product into one liter of tap water, at a temperature of 17° C. The dispersion was rapid and homogeneous and the viscosity of this dispersion was of about 250 centipoises. Another aqueous dispersion containing 20% of this quaternary ammonium salt was prepared, and its viscosity was 600 centipoises.

COMPARATIVE EXAMPLE 2A

By way of comparison, a quaternary ammonium salt was prepared from the above described secondary amine of unhydrogenated tallow fatty acid. After quaternization and filtration of the salt formed, the product obtained comprised 75% quaternary ammonium salt dispersed in a mixture of water and isopropyl alcohol. At room temperature, a partial crystallization of the product occurred, said crystallization increasing thereafter. In order to prepare an aqueous dispersion containing 5% quaternary ammonium salt, it was necessary to heat both water and product at a temperature of about 40° C. Additionally, a gelification of the product occurred during the preparation of an aqueous dispersion containing 10% of this quaternary ammonium salt.

COMPARATIVE EXAMPLE 2B

Again by way of comparison, a quaternary ammonium salt was prepared from a mixture of alcohols comprising a saturated straight chain alcohol and a synthetic alcohol. The composition of the mixture was as follows:

| | |
|---|---|
| Aliphatic chain in $C_{11}$ | 1% by weight |
| $C_{12}$ | 9.1% |
| $C_{12}$ branched | 3.1% |
| $C_{13}$ | 9.2% |
| $C_{13}$ branched | 3.1% |
| $C_{14}$ | 11.4% |
| $C_{14}$ branched | 3.5% |
| $C_{15}$ | 7.2% |
| $C_{15}$ branched | 2.4% |
| $C_{16}$ | 32.5% |
| $C_{18}$ | 17.5% |

The obtained quaternary ammonium salt was comprised of about 13% by weight of branched aliphatic chains and 55% by weight of aliphatic chains having less than 16 carbon atoms.

The final composition comprising 70% of said quaternary ammonium salt in a mixture of water and isopropyl alcohol, was liquid at room temperature and was easily dispersed in the cold state. However, during the preparation of an aqueous dispersion containing 15% of quaternary ammonium salt, a gelification of the product occurred. Also, this product had lower softening properties as indicated in Tables I below which gives test results for softening properties.

EXAMPLE 3

According to a usual process, one quaternary ammonium salt was prepared from a secondary amine of unhydrogenated tallow, such as that described in example 1. Another quaternary ammonium salt was prepared from a secondary amine prepared from a mixture of alcohols comprising a saturated straight chain alcohol and a synthetic alcohol. The composition of the mixture of alcohol was as follows:

| | |
|---|---|
| Chains in $C_{11}$ | 1% by weight |
| $C_{12}$ | 9.1% by weight |
| $C_{12}$ branched | 3.1% by weight |
| $C_{13}$ | 9.2% |
| $C_{13}$ branched | 3.1% |
| $C_{14}$ | 11.4% |
| $C_{14}$ branched | 3.5% |
| $C_{15}$ | 7.2% |
| $C_{15}$ branched | 2.4% |
| $C_{16}$ | 32.5% |
| $C_{18}$ | 17.5% |

The quaternary ammonium salts obtained were mixed together in a weight ratio of 1/1 in order to form a product comprising 75% of quaternary ammonium salt in a mixture of water and isopropyl alcohol. This product was liquid at room temperature and was comprised of about 25% by weight of chains having less than 16 carbon atoms, about 7% by weight of branched aliphatic chains, and about 25% by weight of unsaturated aliphatic chains. The iodine index of the mixture of quaternary ammonium salts was 20.

A textile softener was prepared by dispersing 67 grams of this product in one liter of tap water at 17° C. Additionally, a concentrated dispersion containing 20% of this product was prepared without observing any gelification.

EXAMPLE 4

A quaternary ammonium salt was prepared from a mixture of fatty acids having the following composition:

| | |
|---|---|
| Aliphatic chains lower than $C_{14}$ | 4.6% by weight |
| Aliphatic chains in $C_{14}$ | 4.2% by weight |
| $C_{14}$ branched | 2.1% |
| $C_{16}$ | 18% |
| $C_{16}$ branched | 14% |
| $C_{18}$ | 14% |
| $C_{18}$ branched | 27.6% |
| $C_{18'}$ | 6% |
| $C_{18''}$ | 4% |
| $C_{20}$ | 1% |
| $C_{20}$ branched | 4.5% |

This mixture of fatty acids had an iodine index of 43, and the proportion of branched aliphatic chains amounted to 48.2% by weight.

This mixture of fatty acids was successively converted into secondary amine and then to a quaternary ammonium salt, according to known processes. The product obtained comprised 75% quaternary ammonium salt in a mixture of water and isopropyl alcohol. This product was liquid at room temperature and easily dispersible in the cold state, to form textile softener compositions either diluted or concentrated up to 20%.

EXAMPLE 5

Preformance tests were carried out on the liquid textile softeners prepared in the preceding examples 1 through 4. The amounts of product used during the rinsing cycle were determined on the basis of 0.1% of active matter with regard to the weight of dry linen to be treated.

The yellowing effect after treatment of white linen was determined by means of a Hunterlab D-25 reflectometer using the scale of value Hunter L a, b and more particularly the positive b value. The results obtained showed that the compositions of the invention have no yellowing effect on the treated linen.

The antistatic effect of the compositions of the invention was determined and the results set forth in Table I below. This test consisted in electrically charging, by means of rubbing, well-defined pieces of linen which have been treated with the textile softener compositions. The electrically charged pieces of linen are put on a metallic surface, this latter being inclined. The time during which the piece of linen remains attracted by the metallic surface is measured.

TABLE I

| | Antistatic Test Attraction time (in seconds) |
|---|---|
| Control | 74 |
| Example 1 | 20 |
| Example 2 | 22 |
| Example 2A | 21 |
| Example 2B | 32 |
| Example 3 | 21 |
| Example 4 | 15 |

The softening effect was determined by 8 skilled persons who classify the treated linen by means of a touch comparison, with a quotation ranging from 10 to 1 from the smmother to the rougher. The results of this testing are set forth in Table II below.

TABLE II

| | Softening Test Skilled Persons | | | | | | | | Average |
|---|---|---|---|---|---|---|---|---|---|
| | 1 | 2 | 3 | 4 | 5 | 6 | 7 | 8 | of Tests |
| Control | 7 | 7 | 3 | 6 | 3 | 2 | 6 | 6 | 5.0 |
| Example 1 | 9 | 9 | 7 | 8 | 7 | 8 | 5 | 8 | 7.625 |
| Example 2 | 8 | 8 | 6 | 8 | 9 | 7 | 6 | 6 | 7.25 |
| Example 2A | 7 | 7 | 5 | 6 | 5 | 4 | 5 | 6 | 7.625 |
| Example 2B | 7 | 7 | 5 | 5 | 6 | 4 | 5 | 5 | 5.5 |
| Example 3 | 9 | 7 | 7 | 8 | 8 | 6 | 7 | 6 | 7.25 |
| Example 4 | 9 | 8 | 8 | 6 | 9 | 8 | 7 | 6 | 7.625 |

Control means an untreated linen.

We claim:

1. Quaternary ammonium salt compositions comprising a mixture of quaternary ammonium salts having the general formula

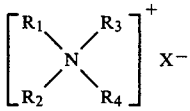

wherein $R_1$ and $R_2$ are aliphatic radicals having from 10 to 22 carbon atoms, and wherein (a) from 40 to 75% by weight of the entirety of these radicals are saturated aliphatic straight chains, and (b) from 5 to 45% by weight of the entirety of these radicals are unsaturated aliphatic chains, and (c) from 3 to 55% by weight of the entirety of these radicals are branched aliphatic chains, the sum of a+b+c being equal to 100, and wherein $R_3$ and $R_4$, which may be identical or different, are alkyl radicals having from 1 to 4 carbon atoms, and X is a conventional quaternary anion.

2. The compositions of claim 1 wherein the saturated aliphatic straight chains of radicals $R_1$ and $R_2$ comprise 20 to 35% by weight of chains having from 12 to 15 carbon atoms and 80 to 65% by weight of chains having from 16 to 18 carbon atoms, with a major proportion of chains having from 16 to 18 carbon atoms, when the branched aliphatic chains of said radicals amount to 3 to 9% by weight and when the unsaturated aliphatic chains amount to 5 to 45% by weight.

3. The compositions of claim 1, wherein the total amount of saturated aliphatic straight chains of less than 16 carbon atoms of radicals $R_1$ and $R_2$, does not exceed 10% by weight of the total amount of aliphatic chains, when the branched aliphatic chains of said radicals amount to 12 to 55% by weight.

4. The compositions of claim 1 wherein X is selected from the group comprising chlorine, bromine, the radical $CH_3So_4^-$, and nitrate radicals, acetate radicals or an ethylsulfate radical.

5. The compositions of claim 1 wherein said compositions comprise from 80 to 20% by weight of a quaternary ammonium salt prepared from a mixture of alcohols comprising straight chain aliphatic alcohols having from 16 to 22 carbon atoms and oxo alcohols having chains of from 10 to 16 carbon atoms, and from 20 to 80% by weight of a quaternary ammonium salt prepared from a fatty acid whose saturated and unsaturated chains have from 12 to 22 carbon atoms.

6. The compositions of claim 5 wherein the fatty acid is an unhydrogenated tallow fatty acid.

7. The compositions of claim 5 wherein said compositions comprise a quaternary ammonium salt prepared from a mixture comprising (A) from 80 to 20% by weight of an amine resulting from a mixture of alcohols comprising straight chains aliphatic alcohols having from 16 to 22 carbon atoms and oxo alcohols whose chains have from 10 to 16 carbon atoms, and (B) from 20 to 80% by weight of an amine resulting from a fatty acid whose saturated and unsaturated aliphatic chains have from 12 to 22 carbon atoms.

8. The compositions of claim 1 which comprise a quaternary ammonium salt resulting from a mixture of fatty acids whose composition comprises from 40 to 75% by weight of fatty acids containing saturated aliphatic straight chains having from 12 to 22 carbon atoms, from 5 to 45% by weight of fatty acids containing unsaturated aliphatic chains from 12 to 22 carbon atoms and from 3 to 55% by weight of fatty acids containing branched aliphatic chains having from 12 to 22 carbon atoms.

9. A textile softener composition comprising a quaternary ammonium salt mixture disposed in an aqueous medium, said quaternary ammonium salt mixture comprising a mixture of quaternary ammonium salts having the general formula

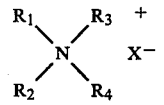

wherein $R_1$ and $R_2$ are aliphatic radicals having from 10 to 22 carbon atoms, and wherein (a) from 40 to 75% by weight of the entirety of these radicals are saturated aliphatic striaght chains, and (b) from 5 to 45% by weight of the entirety of these radicals are unsaturated aliphatic chains, and (c) from 3 to 55% by weight of the entirety of these radicals are branched aliphatic chains, the sum of a+b+c being equal to 100, and wherein $R_3$ and $R_4$, which may be identical or different, are alkyl radicals having from 1 to 4 carbon atoms, and X is a conventional quaternary anion.

* * * * *